US006104824A

United States Patent [19]

Ito

[11] Patent Number: 6,104,824

[45] Date of Patent: Aug. 15, 2000

[54] HEADPHONE DEVICE WITH HEADBAND ARRANGED AROUND OCCIPITAL REGIONAL OF THE HEAD

[75] Inventor: Tomohiro Ito, Kanagawa, Japan

[73] Assignee: Sony Corporation, Tokyo, Japan

[21] Appl. No.: 09/033,606

[22] Filed: Mar. 3, 1998

[30] Foreign Application Priority Data

Mar. 13, 1997 [JP] Japan ..... 9-059025

[51] Int. Cl.[7] ..... H04R 25/00

[52] U.S. Cl. ..... 381/381; 381/370; 379/430

[58] Field of Search ..... 381/330, 370, 381/374, 326, 380, 381, 151, FOR 149, FOR 150; 379/430

[56] References Cited

U.S. PATENT DOCUMENTS 5,457,751 10/1995 Such ..... 381/183

*Primary Examiner*—Paul Loomis
*Assistant Examiner*—P. Dabney
*Attorney, Agent, or Firm*—Jay H. Maioli

[57] ABSTRACT

A headphone device and to a technique that makes the headphone device both easy to wear and comfortable when being worn. The headphone device is constructed in such a manner that the positional relationship between driver units and auricles does not change and includes one driver unit and a headband having flexibility and resilience for supporting the driver unit. The headband is arranged around the occipital region of the head when put on the head in such a manner that the driver unit is pressed onto an auricle by the resilience. The headphone device is provided with at least one engaging member having a support coming into contact with an upper side of a root of the auricle, and an auxiliary support coming into contact with a rear side of the root of the auricle.

13 Claims, 8 Drawing Sheets

HEADPHONE DEVICE WITH HEADBAND ARRANGED AROUND OCCIPITAL REGIONAL OF THE HEAD

BACKGROUND OF THE INVENTION

1. Field of the Invention

The present invention relates to a headphone device that is both easy to wear and comfortable when being worn.

2. Description of Related Art

Conventionally, headphone devices have been provided with driver units at each end of a resilient headband with the headphone device then being worn with the headband put around the occipital region of head.

FIG. 1 shows an example of such kind of headphone device as described above. Here, a headphone device a comprises driver units b, b (with only one being shown in FIG. 1) and a headband c supporting the driver units b, b at each end. Electro-acoustic converting means appropriate for converting electrical signals into acoustic oscillations are then provided within the driver units b, b.

The headband c is constituted by an approximately belt-shaped flexible material and comprises, for example, a metal spring material, with the driver units b, b being supported so as to be suspended at the ends of the headband c.

The headphone device a is put on a head d by slightly broadening the space between the ends of the headband c from the side of occipital region of head e so that the driver units b, b are brought in position on the ears, with the driver units b, b then pressed onto auricles f, f (only one of which is shown in FIG. 1). When the headphone device a is put onto the head d, the headphone device a is positioned in such a manner that parts of the ends of the headband c are on the upper parts of the auricles f, f with the headband c being put around from the back side, and the driver units b, b are pressed onto the auricles f, f by the resilience of the headband c. In this way, the auricles f, f become loosely sandwiched between the headband c with the driver units b, b. At the same time, the middle of the headband c comes into contact with or rides on the neck or collar of the wearer at the side of the occipital region of - head e so as to be put on the head d.

When this related headphone device is put on as described above, the driver units b, b support the weight of the headphone device a which is supported as a result of the resilience of the headband c and as a result of the driver units b, b and both ends of the headband c sandwiching the auricles f, f. However, this structure cannot be considered to be actively supporting the weight of the headphone device a because the middle part of the headband c is coming into contact with or riding on the occipital region of head e, the neck or the collar at the side of the occipital region of head e.

Unfortunately, when, for example, the headband c comes into contact with the collar of clothes with movement of the head of the user of the headphone device a, so that stress is generated in the headband c to easily change the position of the headband c. As a result, the positional relationship between the driver units b, b and the auricles f, f is changed with the movement of the headband c. This causes changes in volume and quality of the sound that the user can hear from the left and right drivers b, b and unnecessary pressure exerted on the auricles f, f, which can make the user feel uncomfortable.

The interposing of a hinge etc. between the driver units b, b and the headband c so that changes in the position of the headband c do not affect the driver units b, b has been considered as a countermeasure for the above problems.

However, with the headphone device a, a certain amount of pressure is required for the driver units b, b to be pressed against the auricles f, f. If a structure is then adopted where a hinge etc. is interposed between the driver units b, b and the headband c, it becomes difficult for the force due to the resilience of the headband c to be transmitted to the driver units b, b and the force pressing the driver units b, b against the auricles f, f therefore becomes weak. It has therefore been very difficult to achieve a situation where both the relationship of the positions of the driver units b, b and the auricles f, f do not change due to changes in the position of the headband c and the force pressing the driver units b, b against the auricles f, f at a certain pressure is maintained, with this problem never having been fully resolved.

When the headband c for the headphone device a is constructed from a resilient material where a metal spring material etc. is approximately belt-shaped so that the position of the headphone device a being put on mostly depends just on the headband c, if the resilience of the headband c is made large, the driver units b, b are pressed strongly against the auricles f, f. It then becomes difficult to make ensured stability in wearing the headphone device a in compatible with alleviation of the load placed on the head d or the auricles f, f when the headphone device a is worn for long periods of time by making the headphone device a in compliance with all of shapes of heads or auricles whose individual differences are large.

With a structure such as that of the headphone device a where the driver units b, b and both ends of the headband c sandwich the auricles f, f, no mechanism is provided for maintaining clearance between the driver units b, b and the ends of the headband c when the headphone device a is put on. Before putting on the headphone device a the user therefore makes the gap between the driver units b, b and the ends of the headband c wider than the width of the auricles f, f and after putting on the headphone device a the user has the troublesome task of adjusting the gap between the driver units b, b and the headband c by groping.

SUMMARY OF THE INVENTION

It is an object of the headphone device of the present invention to resolve the aforementioned problems.

In order to achieve this object there is provided by the present invention a headphone device comprising at least one driver unit and a headband having flexibility and resilience for supporting the at least one driver unit. The headband is arranged around the occipital region of the head when put on the head in such a manner that the driver unit is pressed onto an auricle by the resilience. The headband is provided with at least one engaging member having a support coming into contact with an upper side of a root of the auricle, and an auxiliary support coming into contact with a rear side of the root of the auricle.

Further, in order to achieve the aforementioned object of resolving the aforementioned problems, as a headphone device of the present invention there is provided a headphone device comprising at least one driver unit and a headband having flexibility and resilience for supporting the driver unit. The headband is arranged around the occipital region of the head when put on the head in such a manner that the driver unit is pressed onto an auricle by the resilience. The headband is provided with at least one engaging member having a support coming into contact with an upper side of a root of the auricle, and an auxiliary support coming into contact with a rear side of the root of the auricle and having an opening formed therein except for an edge portion of the auxiliary support.

DETAILED DESCRIPTION OF THE PREFERRED EMBODIMENTS

Figure 1:
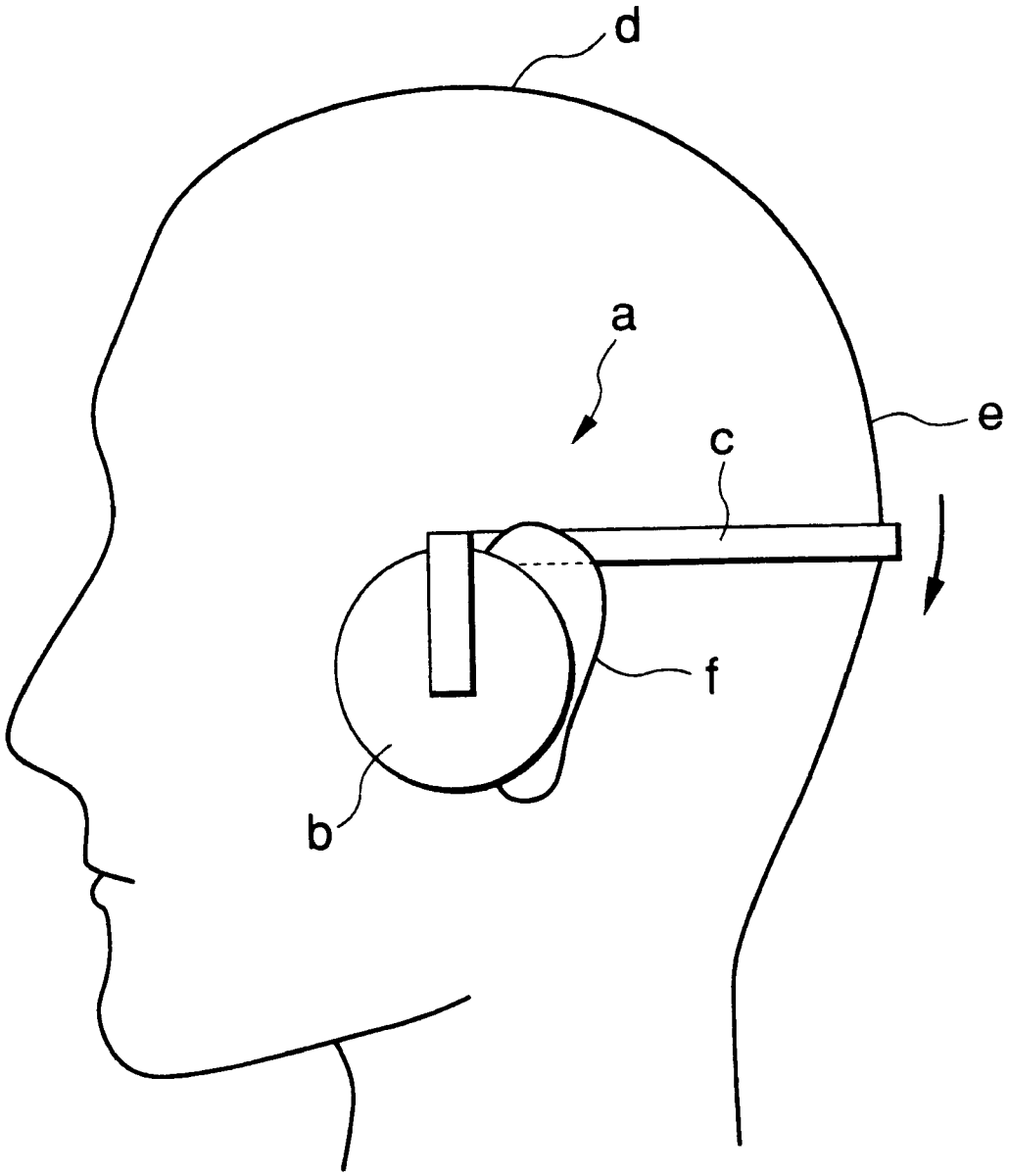
FIG. 1 is a side view showing an example of a related headphone device.

The following is a description of the embodiments of a headphone device of the present invention given in accordance with each of the embodiments shown in the drawings.

First Embodiment

Figure 2:
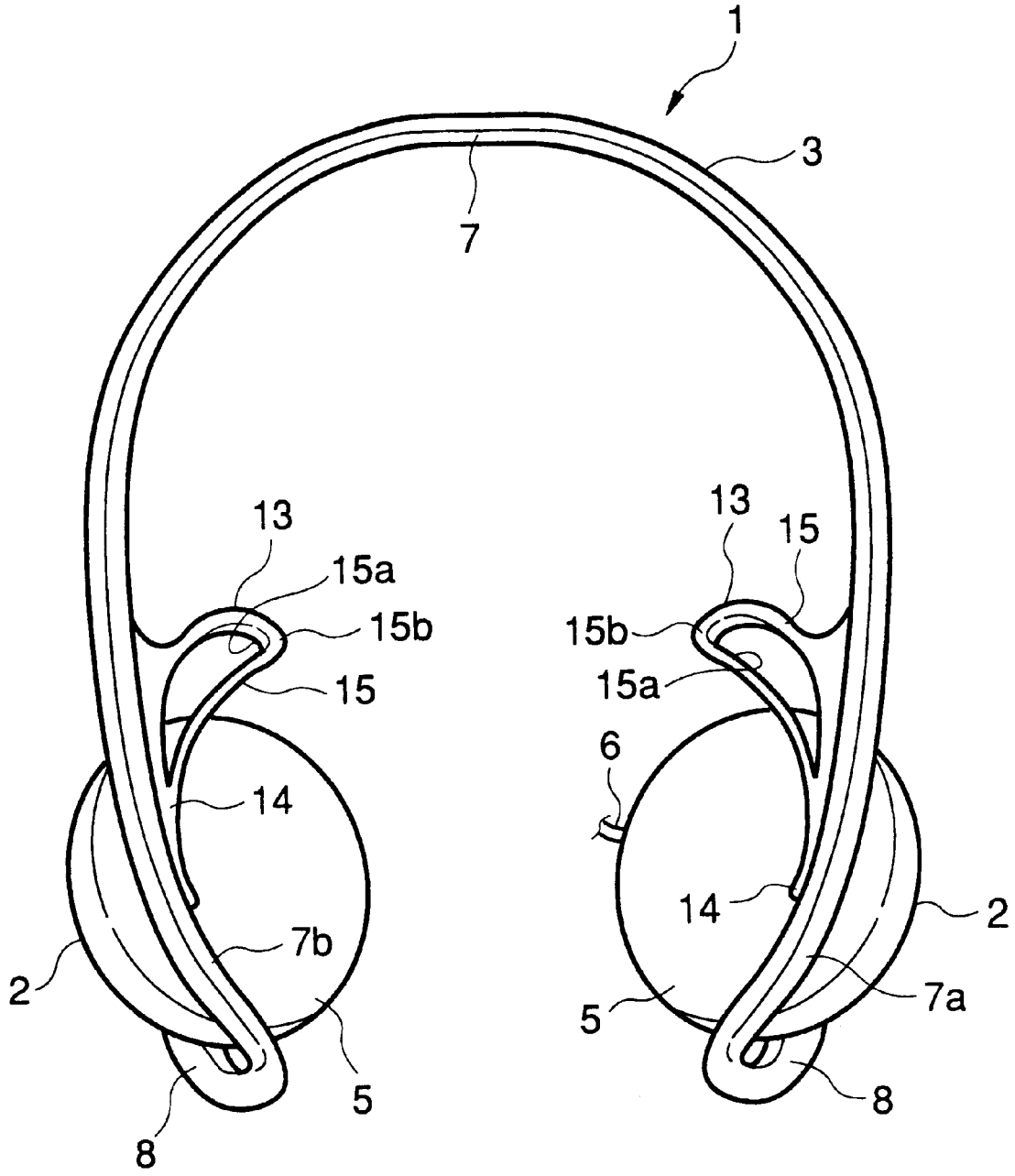
FIG. 2 is a top plan view of the first embodiment of a headphone device of the present invention.

FIG. 2 shows the first embodiment of a headphone device of the present invention.

Here, a headphone device 1 comprises a pair of driver units 2, 2 provided at each end of a headband 3 so as to be supported by this headband 3.

Figure 4:
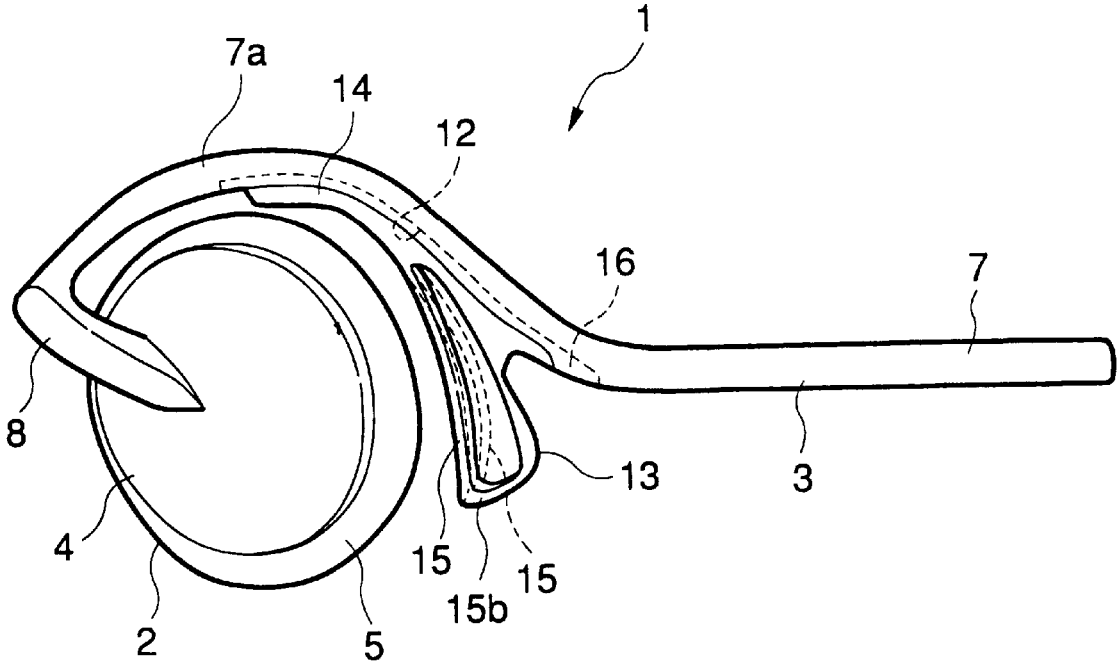
FIG. 4 is a side view of the headphone device of FIG. 2.

When the front, rear, left and right directions are referred to in the following description, the upper and lower directions of FIG. 2 are taken to be backward and forward directions, the left and right directions are taken to be right and left directions. The upper and lower directions of FIG. 4 are remained as they are.

Figure 3:
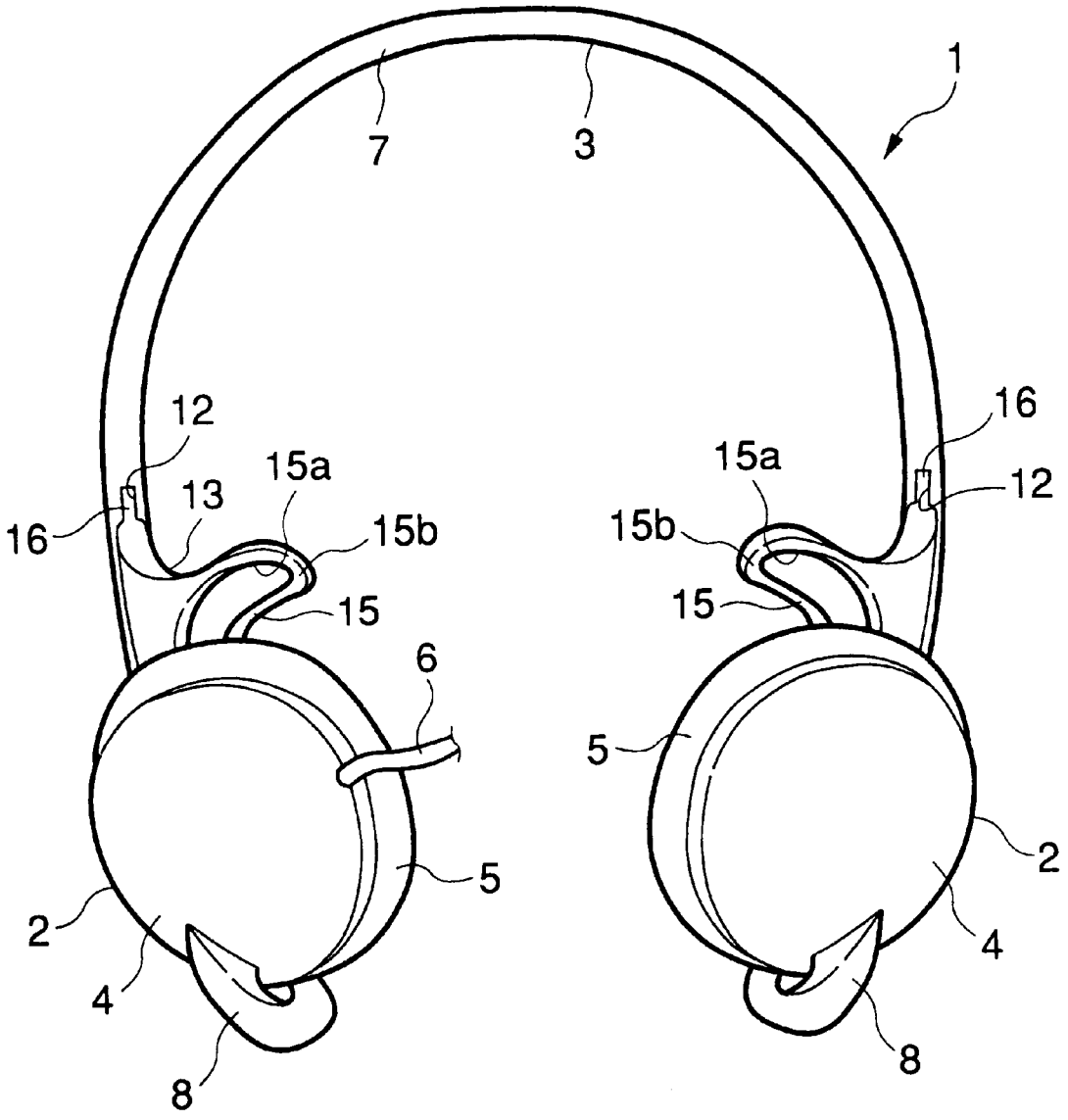
FIG. 3 is a bottom view of the headphone device of FIG. 2.

As shown in FIG. 2 and FIG. 3, the driver units 2, 2 are provided with housings 4 that are approximately bowl-shaped, and ear pads 5 that are approximately plate-shaped and are attached to the housings 4. Within the housings 4, 4, there are provided, although not shown in the drawings, such means as speakers for converting electrical signals into acoustic oscillations. An external cord 6 is connected to a speaker of one of the driver units 2. The other cord not shown in the drawings then passes within the headband 3 so as to be connected to the speaker within the remaining driver unit 2.

The headband 3 comprises a main part 7 formed with a cross-section in a flat, elliptical shape, a left end part 7*a* and right end part 7*b* positioned ahead of the main part 7 and driver unit linking parts 8, 8 continuing on from the left end part 7*a* and the right end part 7*b*. They are integrally formed of a flexible and resilient material such as polypropylene.

Figure 5:
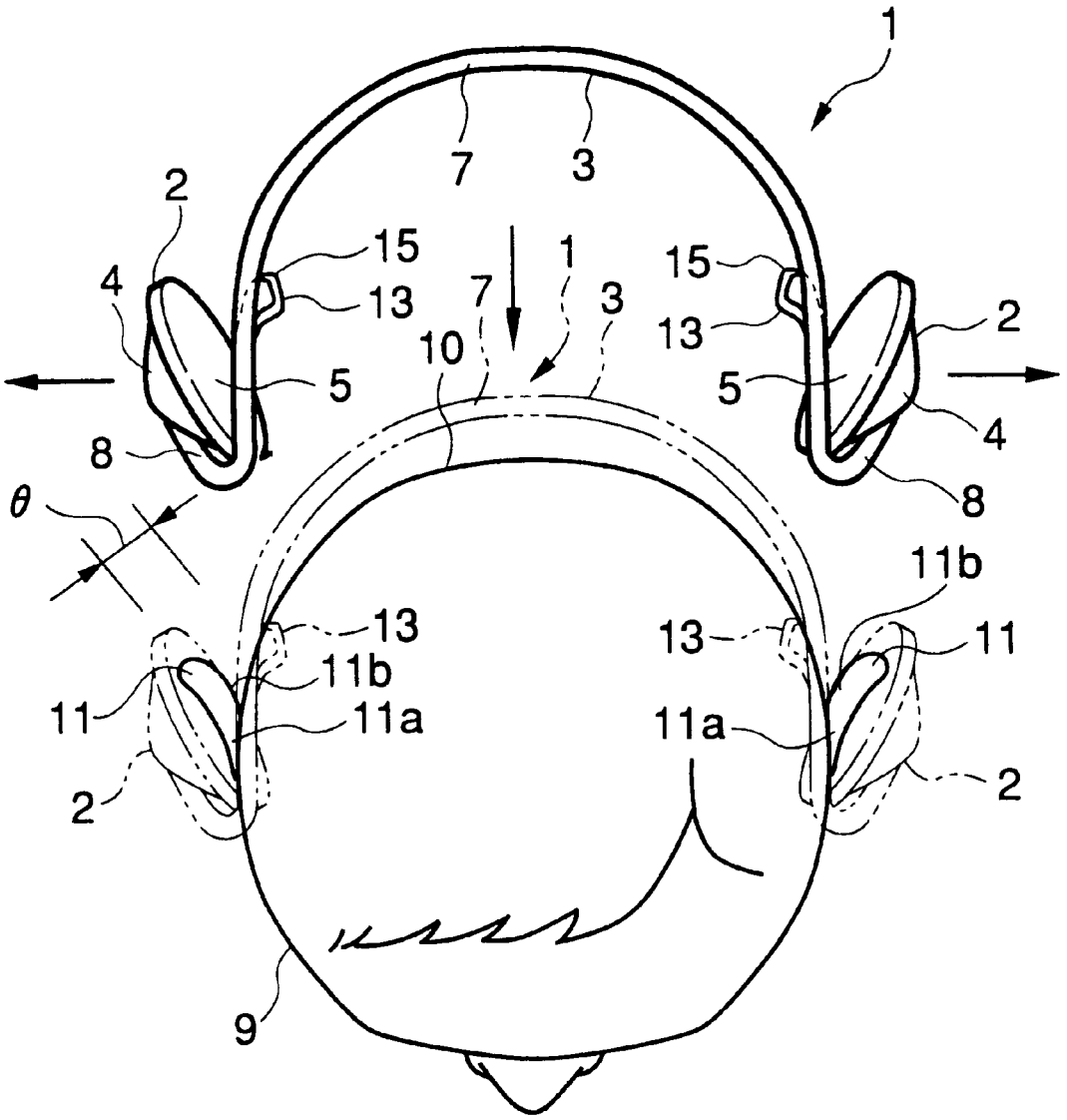
FIG. 5 illustrates a procedure for putting on a headphone device viewed from above.

The main part 7 of the head band 3 is formed in a curved shape so as to fit the shape of a typical person's head 9 and more particularly to fit the shape of an occipital region of head 10, as shown in FIG. 5. The overall shape of the headband 3 is then approximately that of an omega (Ω).

As shown in FIG. 4, the left end part 7*a* and the right end part 7*b* of the headband 3 are formed so as to curve in an upper direction overall so as to approximately run along the upper sides of auricles 11, 11.

At the left end part 7*a* and the right end part 7*b* of the headband 3, slits 12, 12 opening in a downward direction for attaching an engaging member to be described later are formed.

The driver unit linking parts 8, 8 slant in a downward direction from the left end part 7*a* and the right end part 7*b* and are then turned back so as to be displaced in a direction towards the rear. The driver unit linking parts 8, 8 are formed in such a shape that the spacing between the headband 3 and each of the linking parts becomes more open towards the tips of the driver unit linking parts 8, 8, i.e. formed so as to head leftwards and rightwards towards the tips of the driver unit linking parts 8, 8. The tips of the driver unit linking parts 8, 8 are linked to the housings 4, 4 at positions in the regions of the front sides of the driver units 2, 2 so that the driver units 2, 2 are supported with the surfaces of the ear pads 5, 5 in contact with the auricles 11, 11 being inclined rearwards as well as slightly upwards.

Engaging members 13, 13 comprise supports 14, 14 constituting front half portions and auxiliary supports 15, 15 constituting rear half portions formed integrally. These engaging members 13, 13 hang from the top and the rear at the roots of the auricles 11, 11 in the same way as ear pieces of glasses, so as to support the weight of the headphone device 1 and keep the headphone device 1 in a stable position. The engaging members 13, 13 are formed from a material such as elastomer that is softer and more flexible than that of the headband 3 so as not to be affected by individual differences in the shapes of roots of auricles 11, 11 and so as to alleviate the load when the headphone device 1 is worn.

Figure 6:
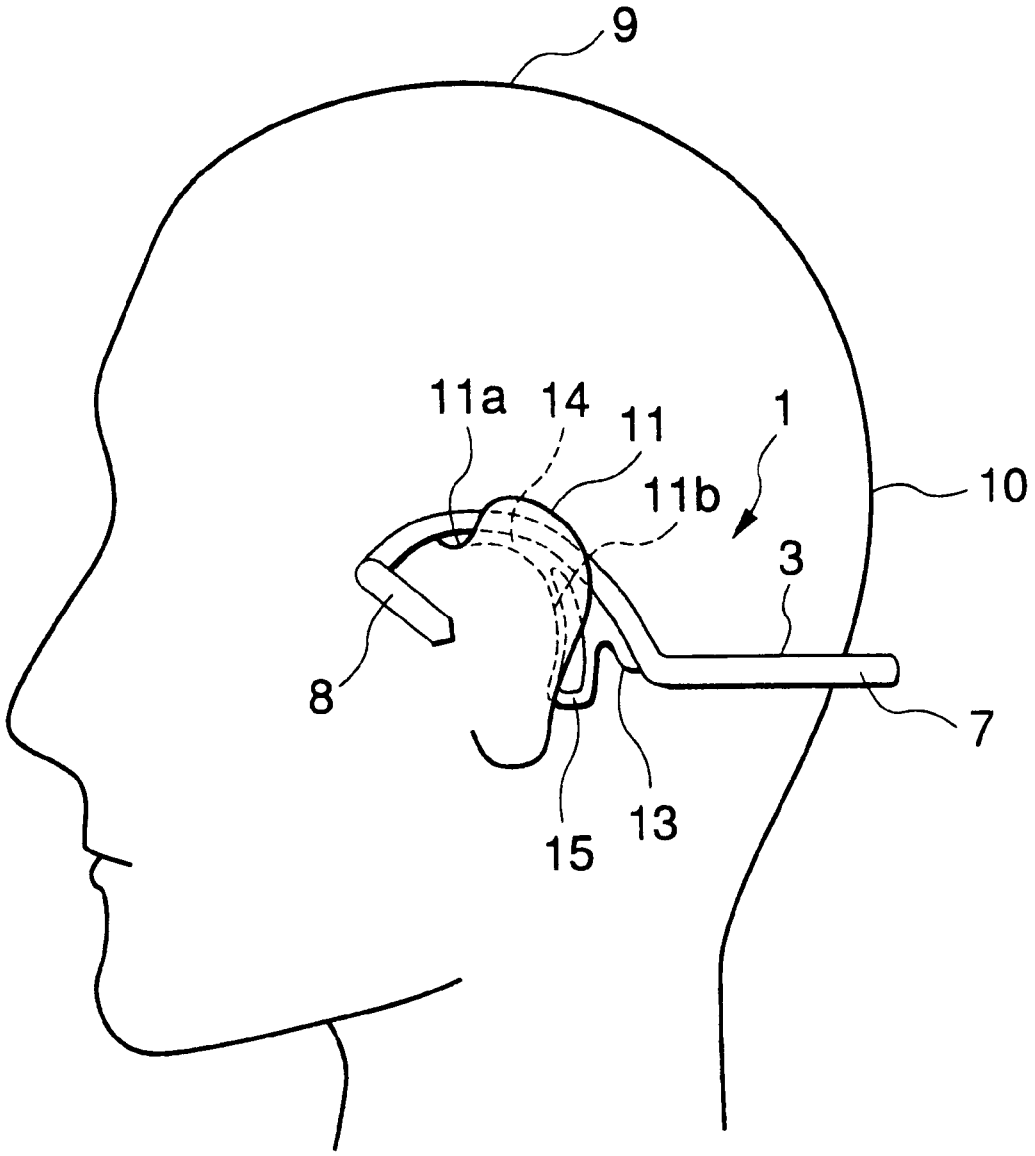
FIG. 6 is a side view showing a state in which the headphone device of FIG. 2 is worn with a driver unit being removed.

As shown in FIG. 6, the supports 14, 14 are formed in protrusion-like shape with rounded angles so as to come into contact with upper side roots 11*a*, 11*a* of the auricles 11, 11 so as to support the majority of the weight of the headphone device 1 with the exception of the main part 7 of the headphone 3.

The auxiliary supports 15, 15 are portions coming into contact with rear side roots 11*b*, 11*b* of the auricles for preventing the main part 7 of the headband 3 from dropping down by its own weight in the direction of the arrow shown in FIG. 6 with the front ends of the supports 14, 14 taken as fulcrums. Openings 15*a*, 15*a* are also provided except for the edges for making flexible as a whole. The auxiliary supports 15, 15 therefore become easily flexed, as shown by the dashed line in FIG. 4, and make contact with the rear side roots 11*b*, 11*b* of the auricles in a softer manner when compared to other portions of the engaging members 13, 13. Further, the auxiliary supports 15, 15 are formed so that the lower end parts 15*b*, 15*b* can be bent to the left or right more than other portions, i.e. bent to the side of the head 9 so that the headphone device 1 is easily held in a stable state when worn.

Thin plate-like projections 16, 16 that are fitted to slits 12, 12 of the headband 3 as shown in FIG. 4 are integrally formed at the upper ends of the engaging members 13, 13.

As shown in FIG. 2 and FIG. 4, the fitting projections 16, 16 are inserted into the slits 12, 12 so that the engaging members 13, 13 are fixed to the left end part 7*a* and the right end part 7*b* of the headband 3. In doing so, the engaging members 13, 13 extend along the shape of the left end part 7*a* and the right end part 7*b* of the headband 3, with the supports 14, 14 and the auxiliary supports 15, 15 displaced to the left and right toward the lower end of the headphone device 1, i.e. displaced to the sides of the head 9 at the time of putting on the headphone device 1 so as to become suspended. The lower end parts 15*b,* 15*b* of the auxiliary supports 15, 15 are formed as the portions that project the furthest to the left and right at the side of the head 9 when the headphone device 1 is put on.

The headphone device 1 is put on the head 9 in the way described in the following.

The user takes hold of the driver units 2, 2 as shown in FIG. 5 so as to widen the gap between the left end part 7*a* and the right end part 7*b* of the headband 3 while sandwiching his head into this gap from the side of the occipital region of head 10 so that the auricles 11, 11 are positioned into the gap between the ear pads 5, 5 and the engaging members 13, 13. The left end part 7*a* and the right end part 7*b* of the headband 3 are then made to pass through a position slightly up the auricles 11, 11 so that the headphone device 1 is moved forward as a whole.

When the auxiliary supports 15, 15 of the engaging members 13, 13 come into contact with the rear side root 11*b,* 11*b* of the auricles, the user then releases the hold of the whole of the headphone device 1 which has been pushed slightly downwards so that the supports 14, 14 come into contact with the upper side root 11*a,* 11*a* of the auricles. In doing so, the ear pads 5, 5 of the driver units 2, 2 are pressed from the side onto the auricles 11, 11 by the force of the flexed headband 3 exerted in returning to its original position while at the same time the ear pads 5, 5 are positioned on the auricles 11, 11, with the putting on the headphones then being complete.

When the headphone device 1 is put on, since the driver units 2, 2 are supported in such a manner that the surfaces of the ear pads 5, 5 in contact with the auricles 11, 11 are inclined rearwards as well as slightly upwards by means of the driver unit linking parts 8, 8 of the headband 3, the user just taking hold of the driver units 2, 2 and lightly pulling these driver units 2, 2 to the left and right makes the turned back portions between the headband 3 and the driver unit linking parts 8, 8 become supporting points to make a gap θ between the ear pads 5, 5 and the auxiliary supports 15, 15 larger so that the auricles 11, 11 can be easily inserted into this gap 0 as shown in FIG. 5.

The engaging members 13, 13 project to a greater extent to the left and right than the left end part 7*a* and the right end part 7*b* of the headband 3 but as these engaging members 13, 13 have been made of a flexible material the engaging members 13, 13 can be easily flexed and do not provide resistance when the headphone device 1 is put onto the head 9.

Openings 15*a,* 15*a* are provided at the auxiliary supports 15, 15 of the engaging members 13, 13 with the peripheral edge portions of the support openings 15*a,* 15*a* being formed of a flexible material. This therefore makes the engaging members 13, 13 fit to the rear side roots 11*b,* lib of auricles having large individual differences in the shapes and the load on the rear side roots 11*b,* 11*b* of auricles at the time of putting on the headphone device 1 is alleviated. The headphone device 1 therefore keeps the positional relationship of the driver units 2, 2 and the auricles 11, 11 constant and adjustment in positioning the driver units 2, 2 on the auricles 11, 11 is no longer necessary. Shifts in position due to hanging down of the headphone 3 can therefore be prevented.

In the first embodiment, a headphone device 1 where the headband 3 and the engaging members 13, 13 have been formed separately is shown but the headband 3 and the engaging members 13, 13 can be integrally formed.

Second Embodiment

Figure 7:
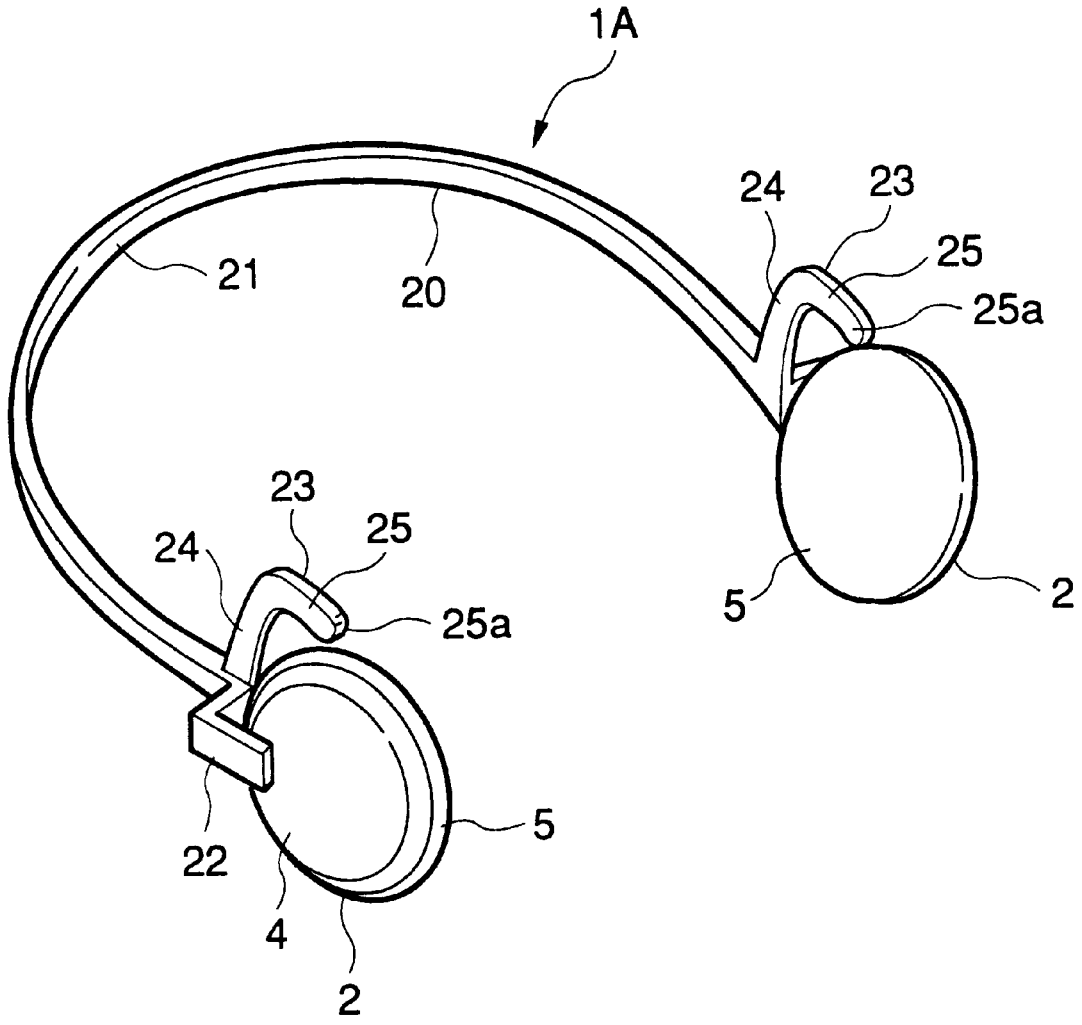
FIG. 7 is a perspective view of the second embodiment of a headphone device of the present invention.
Figure 8:
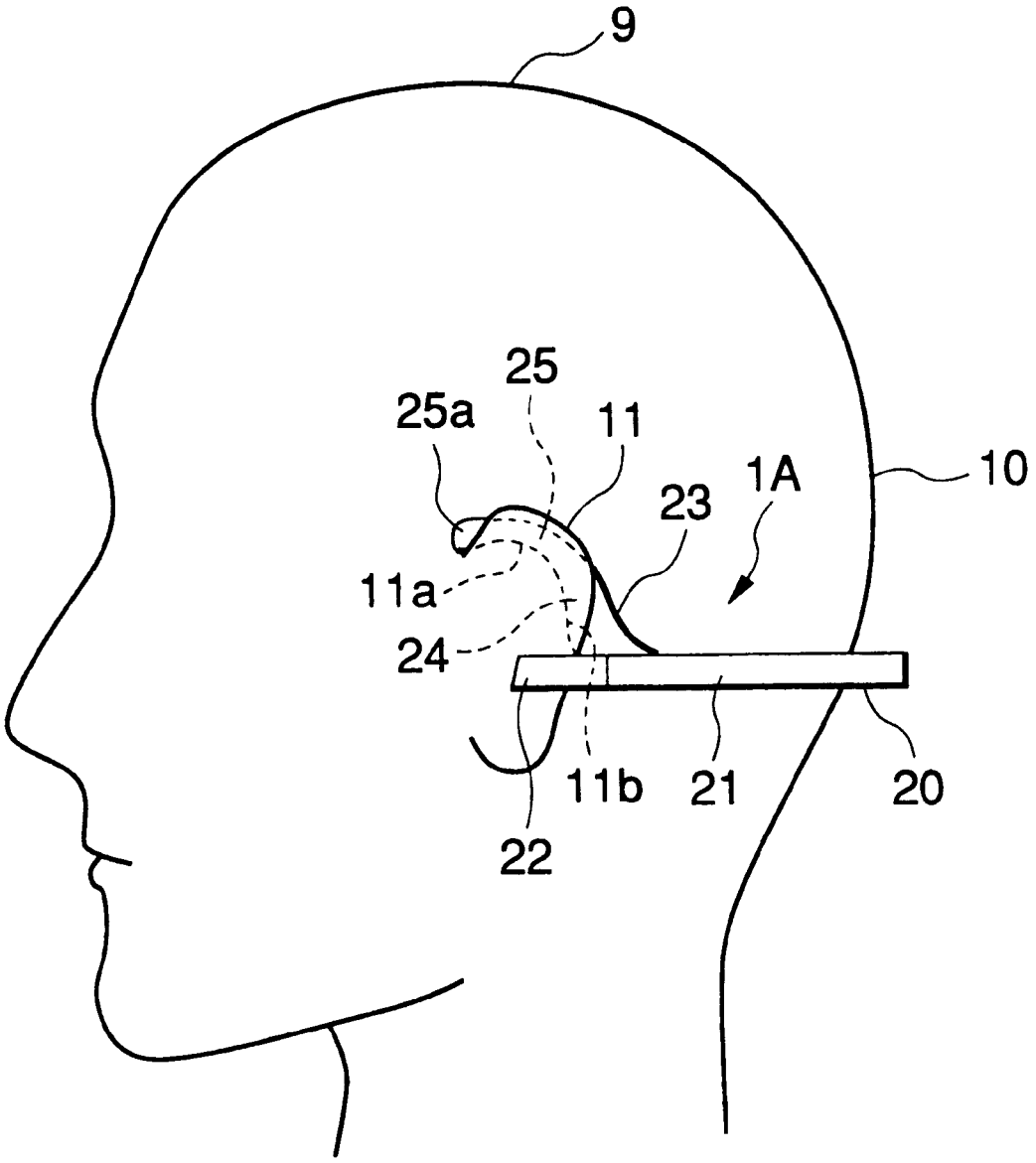
FIG. 8 is a side view showing a state in which the headphone device of FIG. 7 is worn with a driver unit being removed.

FIG. 7 and FIG. 8 show a second embodiment of a headphone device 1A of the present invention which differs from the first embodiment in the shapes of a head arm and engaging member.

In the following description, portions that are the same as portions of the first embodiment are given with the same numerals and their detailed description is omitted.

Here, a headphone device 1A comprises a pair of driver units 2, 2 provided at each end of a headband 20 so as to be supported by this headband 20.

As shown in FIG. 7, the headband 20 has a main part 21 formed as a slightly thick belt shape that is bent in an inverted C shape having an opening towards the front so as to fit the occipital region of head 9 and approximately crank-shaped drive unit linking parts 22, 22 continuously extending from the left and right ends of the main part 21. The drive unit linking parts 22, 22 are at first bent in directions that are at an angle of approximately ninety degrees to the right and left, i.e. towards the outside, then again bent towards the front to an angle of about ninety degrees and then finally extended so as to be inclined towards the right and left. The main part 21 and the drive unit linking parts 22, 22 are formed of a flexible, resilient material such as polypropylene.

Engaging members 23, 23 are both bent and extended upwards from a position slightly towards the rear of the boundary portion of the main part 21 and the drive unit linking parts 22, 22 of the headband 20. The engaging members 23, 23 can either be formed integrally with the headband 20 or can be formed as a separate body of a material that is softer and more flexible than the headband 20 such as an elastomer with this then being fixed using an appropriate method.

The engaging members 23, 23 are formed in plate-shapes that are thinner than the main part 21 and comprise auxiliary supports 24, 24 and supports 25 and 25 in order of proximity to the main part 21. The function of these engaging members 23, 23 is to come into contact with the rear and upper portions of the roots of the auricles 11, 11 so as to support the weight of the headphone device 1A and maintain the headphone device 1A in a stable position in the same way as ear pieces of glasses. These engaging members 23, 23 are formed to be soft so as not to be affected by individual differences in the shape of the auricles 11, 11 and the roots of these auricles 11, 11 and so as to alleviate the load on the auricles 11, 11 when the headphone device 1A is worn.

It is more effective to form the engaging members 23, 23 as separate bodies so as not to be affected by individual differences in the shape of the auricles 11, 11 and differences in the shapes of the roots of these auricles 11, 11 and so as to alleviate the load on the auricles 11, 11 when the headphone device 1A is worn.

The auxiliary supports 24, 24 are portions that come into contact with the rear side roots 11*b,* 11*b* of the auricles 11, 11 and the supports 25 and 25 are portions that come into contact with the upper side roots 11*a,* 11*a* of the auricles 11, 11.

The engaging members 23, 23 are formed in such a manner as to bend to the left and right towards front tips 25*a,* 25*a* of the supports 25, 25 from the linking portion with the headband 20 so that the left and right front tips 25*a,* 25*a* of the supports Z25, 25 are in positions closest to the sides of the head 9.

The auxiliary supports 24, 24 are portions for preventing the main part 21 of the headband 20 from dropping down in the direction of the arrow shown in FIG. 8 by its own weight with the front ends of the supports 25, 25 taken as fulcrums.

The drive unit linking parts 22, 22 of the headband 20 are linked to the housings 4, 4 at positions in the regions of the lower ends of the driver units 2, 2 so that the driver units 2, 2 are supported with the surface of the ear pads 5, 5 in contact with the auricles 11, 11 being inclined rearwards as well as slightly upwards.

The following is a description of putting the headphone device 1A on the head 9.

The user takes hold of part of the driver units 2, 2 and broadens the gap between the left and right tips of the headband 20 to the left and right so as to then position his head 9 from the side of the occipital region of head 10 so as to be sandwiched between the driver units 2, 2. The auricles 11, 11 are then positioned in the space between the ear pads 5, 5 and the engaging members 23, 23 so that supports 25, 25 are inserted between the auricles 11, 11 and the head 9. The whole headphone device 1A is then moved forward until the auxiliary supports 24, 24 come into contact with the rear side roots 11*b*, 11*b* of the auricles. When the user then releases the hold, the supports 25 and 25 come into contact with the roots 11*a*, 11*a*. At the same time, the ear pads 5, 5 of the driver units 2, 2 are pressed onto the auricles 11, 11 from the side by the force of the flexed headband 20 exerted in returning to its original position, so that the ear pads 5, 5 are just positioned on the auricles 11, 11 and putting on of the headphone device 1A is complete.

The headphone device 1A is formed in such a manner that the engaging members 23, 23 can be displaced more to the left and right in portions closer to the tips 25*a*, 25*a* of the supports 25 and 25 away from the portion linked with the headband 20, with the front tips 25*a*, 25*a* of the supports 25 and 25 being in positions closest to the side of the head 9. This provides the widest gaps between the front tips 25*a*, 25*a* and the ear pads 5, 5, so that the user can then easily position the auricles 11, 11 in the spaces between the ear pads 5, 5 and the engaging members 23, 23 and the headphone device can be easily put on the head 9.

As in the case of the engaging member 13 shown in the first embodiment, if openings are provided at the auxiliary supports 24, 24 of the engaging members 23, 23, the engaging members 23, 23 will become easier to bend and the load placed on the rear side roots 11*b*, 11*b* of the auricles can be further alleviated.

The specific form and configuration of each of the parts shown in the embodiments described above are simply given as specific examples of embodiments of the present invention and the technological range of the present invention should by no means be considered to be limited in this respect.

What is claimed is:

1. A headphone device comprising:

a driver unit;

a headband having flexibility and resilience for supporting said driver unit, said headband being arranged around an occipital region of a user's head when worn by said user so that said driver unit is pressed onto an ear of said user by said resilience of said headband; and an engaging member for locating said driver unit on said user's head and having a main support adapted to contact an upper side of a base of said ear and an auxiliary support extending downwardly behind said ear and adapted to contact a rear side of said base of said ear and to prevent said headband from dropping down and contacting the user's neck.

2. The headphone device of claim 1, wherein said engaging member extends in a direction towards a side of said user's head and away from said headband, whereby said driver unit is held in a slanted position relative to said headband.

3. The headphone device of claim 2, wherein said engaging member includes an opening formed therein, whereby said engaging portion is more flexible than said headphone.

4. The headphone device of claim 2, wherein said engaging member is formed of a material softer than a material of said headband, whereby said engaging member is more flexible than said headband.

5. The headphone device of claim 1, wherein said headband includes an end portion which curves upward toward a top of said ear of said user and in a forward direction from a central portion of said headband.

6. The headphone device of claim 5, wherein said headband includes a linking portion connected at said end portion for connecting said headband to an outer surface of said driver unit at a front portion thereof.

7. The headphone device of claim 6, wherein said linking portion extends downward and rearward at an oblique angle when said headband is worn on said user's head.

8. The headphone device of claim 1, wherein said engaging member includes an aperture formed therein, whereby said engaging member is more flexible than said headband.

9. The headphone device of claim 1, further comprising a driver unit linking part for supporting said driver unit on said user's head, wherein said driver unit linking part is provided at a position closer to a front of said user's head than a position of said engaging member, wherein said driver unit linking part extends in a rearward direction relative to said user's head and away from said user's head, said driver unit being supported at an end of said driver unit linking part on an inward facing portion of said driver unit linking part.

10. A headphone device comprising:

a driver unit;

a headband having flexibility and resilience for supporting said driver unit, said headband being arranged around an occipital region of a user's head when worn by said user so that said driver unit is pressed onto an ear of said user by said resilience of said headband; and an engaging member having a front half portion adapted to contact an upper side of a base of said ear and a rear half portion extending downwardly behind said ear and adapted to contact a rear side of said base of said ear to prevent said headband from dropping down into contact with the user's neck and for supporting said driver unit on said user's head, wherein said rear half portion has an aperture formed therein, whereby said engaging member is more flexible than said headband.

11. The headphone device of claim 10, wherein said engaging member extends in a direction towards a side of said user's head and away from said headband.

12. The headphone device of claim 10, further comprising a driver unit linking part for supporting said driver unit on said user's head, wherein said driver unit linking part is provided at a position closer to a front of said user's head than a position of said engaging member, wherein said driver unit linking part extends in a rearward direction relative to said user's head and away from said user's head, said driver unit being supported at an end of said driver linking part on an inward facing portion of said driver unit linking part.

13. A headphone device comprising:

a driver unit;

a headband having resilience for supporting said driver unit and including an integrally formed crank-shaped linking part being attached to a rear portion of said driver unit, said headband being arranged around an occipital region of a user's head when worn by said user so that said driver unit is pressed onto an ear of said user by said resilience of said headband; and an engaging member having a main support adapted to contact an upper side of a base of said ear and an auxiliary support adapted to contact a rear side of said base of said ear to prevent said headband from dropping down into contact with the user's neck, whereby said ear is sandwiched between said driver unit and said engaging member with said engaging member supporting said driver unit on said user's head.

* * * * *